US005687242A

United States Patent [19]

Iburg

[11] Patent Number: 5,687,242

[45] Date of Patent: Nov. 11, 1997

[54] HEARING AID CONTROLS OPERABLE WITH BATTERY DOOR

[75] Inventor: Lester Iburg, Hudson, Wis.

[73] Assignee: Resistance Technology, Inc., Arden Hills, Minn.

[21] Appl. No.: 514,153

[22] Filed: Aug. 11, 1995

[51] Int. Cl.[6] ..... H04R 25/00

[52] U.S. Cl. ..... 381/69.2; 381/68.6

[58] Field of Search ..... 381/68–69; 38/69.2; 429/98, 100, 123, 96; 181/129, 130

[56] References Cited

U.S. PATENT DOCUMENTS

| | | | |
|---|---|---|---|
| 3,138,491 | 6/1964 | Rubio | 381/69.2 |
| 3,209,080 | 9/1965 | Guttner et al. | 381/69.2 |
| 3,475,566 | 10/1969 | Bauer | 381/69.2 |
| 3,828,142 | 8/1974 | Buettner | 179/107 R |
| 4,354,065 | 10/1982 | Buettner | 381/69.2 |
| 4,890,329 | 12/1989 | Erbe | 381/69 |
| 4,922,540 | 5/1990 | Erbe | 381/69 |
| 4,941,180 | 7/1990 | Buettner | 381/69 |
| 4,947,439 | 8/1990 | Buettner | 381/69 |
| 4,965,831 | 10/1990 | Schmid | 381/69.2 |
| 5,062,138 | 10/1991 | Schmid | 381/69.2 |
| 5,341,433 | 8/1994 | Meyer et al. | 381/69 |
| 5,347,584 | 9/1994 | Narisawa | 381/68.6 |
| 5,386,476 | 1/1995 | Bisgaard et al. | 381/69.2 |
| 5,463,692 | 10/1995 | Fackler | 381/68.7 |
| 5,588,064 | 12/1996 | McSwiggen et al. | 381/69.2 |

*Primary Examiner*—Curtis Kuntz
*Assistant Examiner*—Rexford N. Barnie
*Attorney, Agent, or Firm*—Kinney & Lange, P.A.

[57] ABSTRACT

A hearing aid includes a face plate, a battery door, and a switch. The faceplate has an opening formed therein. The battery door is movable within the opening. The switch is operably disposed in the hearing aid so that movement of the battery door activates the switch for control of the hearing aid.

21 Claims, 4 Drawing Sheets

58
42
14
48
54
52
66
78
80
64
62
68
50
46
72
70
44
10
60
60
12
20
74
24
22
34
32
26
30
28
76
16

HEARING AID CONTROLS OPERABLE WITH BATTERY DOOR

BACKGROUND OF THE INVENTION

The present invention relates to an apparatus for controlling the operation of a hearing aid. More particularly, the present invention relates to a hearing aid wherein the operation of the hearing aid is controlled by movement of a battery door.

There are primarily two types of hearing aids, in-the-ear and behind-the-ear. The operation of each type of hearing aid is controlled by one or more switches. Examples of operational features that the switches control include on/off control, volume control, trimmer applications such as noise filtration control, and telecoil control such as a telephone receiver mode, etc.

Efforts have been made to improve the aesthetics of hearing aids by reducing the size of the hearing aid. However, the ability to make hearing aids smaller is limited by the fact that a person who is using the hearing aid must be able to readily operate and control the hearing aid.

A primary method of controlling the operation of the hearing aid is through a potentiometer that is mounted on the faceplate of the hearing aid. For the potentiometer to be mounted on the faceplate, the potentiometer must be quite small, typically less than 0.25 inches in diameter. The size of the potentiometer poses difficulties in operating and reliably mounting the potentiometer in the hearing aid.

SUMMARY OF THE INVENTION

The present invention includes a hearing aid. The hearing aid has a faceplate, an audio component, a battery door, and a switch. The faceplate has an opening formed therein for receiving the battery door. The battery door has a switch activation area and is capable of receiving a battery therein. The battery door is movable within the opening. The switch is operably connected to a hearing aid audio component and is disposed within the hearing aid such that the switch activation area can activate the switch for control of the audio component.

DETAILED DESCRIPTION OF THE PREFERRED EMBODIMENTS

Figure 1:
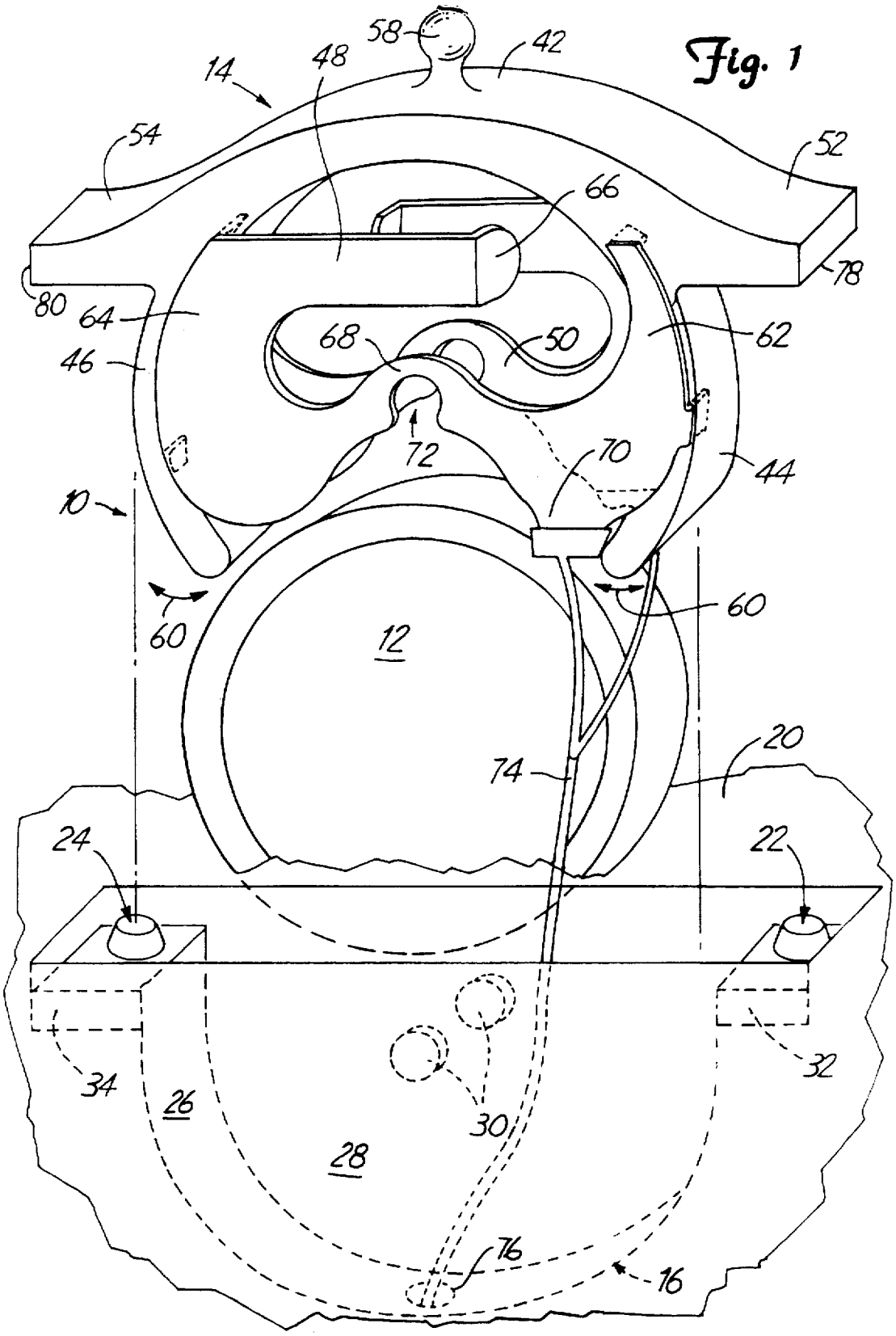
FIG. 1 is a perspective view of a hearing aid switch apparatus of the present invention.
Figure 2:
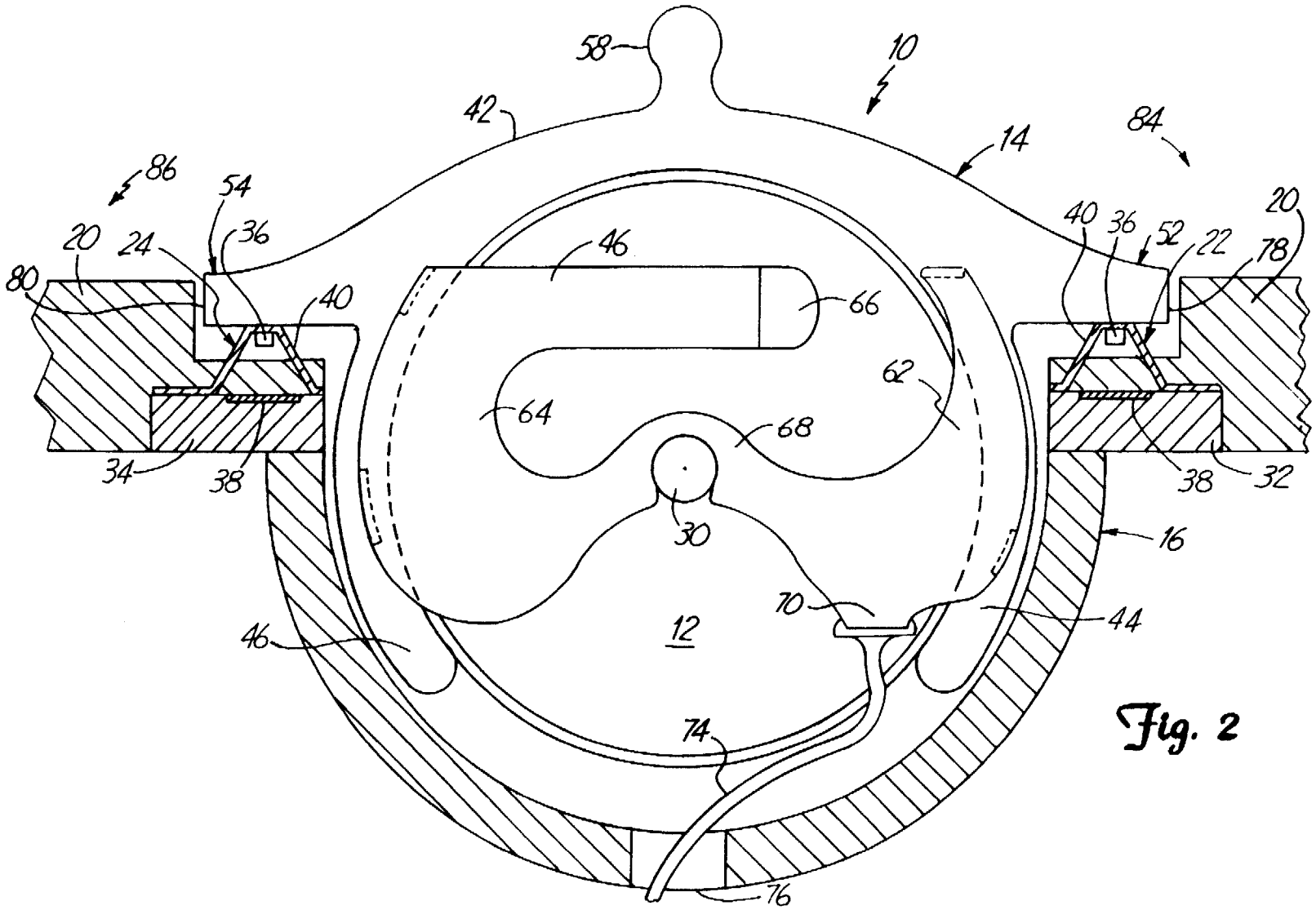
FIG. 2 is a sectional view of the hearing air switch apparatus in an assembled configuration.

FIGS. 1 and 2 illustrate one embodiment of a hearing aid 10, according to the present invention, including a battery 12, a battery door 14, a battery door boot 16, a faceplate 20, and hearing aid control switches 22 and 24. In this arrangement the hearing aid control switches 22 and 24 are operable with and controlled by movement of the battery door 14 relative to the faceplate 20. By combining the structure and function of the battery door 14 with other hearing aid components such as control switches 22 and 24, the size and arrangement of the components is reduced, thereby reducing the size of the faceplate 20 and the overall dimensions of the hearing aid 10. Since the battery door 14 is physically larger than a typical independent control switch, such as a potentiometer, the hearing aid 10 of the present invention is easier to operate than the prior art hearing aids.

The battery 12 and the faceplate 20 are conventional components that are well known in the art. The battery door boot 16 is molded into the faceplate 20 for receiving the battery door 14. The battery door boot is defined by a plurality of opposed side walls 26 and a base wall 28 that extend between the side walls 26.

The battery door 14 is movable within the battery door boot 16 such that the battery door 14 is operable with one or more of the hearing aid control switches 22 and 24 for controlling the operation of the hearing aid 10. For example, the battery door 14 may be pivotally mounted about central pivot pins 30 that are mounted to the side walls 26 in the battery door boot 16.

In the embodiment illustrated in FIGS. 1 and 2, the hearing aid control switches 22 and 24 are shown as a pair of rubber conductive rubber switches, each of which is mounted on a printed circuit board 32 and 34, respectively, for controlling the switch circuitry. Each of the conductive switches 22 and 24 includes an upper contact 36, a lower contact 38, and a rubber shell 40 as best illustrated in FIG. 2. The rubber shell 40 provides an air tight seal over the upper and lower contacts 36 and 38 to prevent impurities from affecting the switch operation.

The upper contact 36 is preferably bonded to an inner surface of the rubber shell 40. The elasticity of the rubber shell 40 maintains the upper contact 36 spaced apart from the lower contact 38, thereby biasing the conductive switches 22 and 24 in an open position. To close one of the conductive switches 22 and 24 an external force must be applied to an exterior of one of the rubber shells 40 to deform it and force the upper contact 36 into electrical communication with the lower contact 38. Upon removal of the external force, the rubber shell 40 springs back to its original shape thereby separating the upper contact 36 from the lower contact 38. Other switches such as membrane sandwich switches as set forth in U.S. patent application Ser. No. 08/273,200, which is assigned to the same assignee as the present application, may also be used and are hereby incorporated by reference.

As shown in FIGS. 1 and 2, the battery door 14 includes a base portion 42, a first leg portion 44, a second leg portion 46, a positive battery contact 48, a negative battery contact 50, a first switch activation area 52, and a second switch activation area 54. The base portion 42 is visible and accessible from an exterior of the hearing aid 10 and provides the main cover and housing for the battery 12. The first leg portion 44 extends from a first end of the base portion 42 into the battery door boot 16. The second leg portion 46 extends from a second end of the base portion 42 into the battery door boot 16.

Each leg portion 44 and 46 is preferably arcuate in shape to conform to the shape of the battery 12. Additionally, each leg portion 44 and 46 is preferably constructed of a flexible plastic material or the like, so that each leg portion 44 and 46 can flex in the directions of double headed arrow 60, thereby permitting the battery 12 to be force fit into and removed from the battery door 14. The battery 12 is thereby retained within the battery door 14 by the base portion 42, leg portions 44 and 46 and battery contacts 48 and 50.

The positive contact 48 is mounted into one side of the leg portions 44 and 46 and the base portion 42 of the battery door 14. The negative contact 50 is mounted into an opposite side of the leg portions 44 and 46 and base portion 42 of the battery door 14. Each contact 48 and 50 includes a first end portion 62 molded into first leg portion 44, a second end portion 64 molded into the second leg portion 46, a scribe tab 66 for contacting the battery 12, a flex pivot area 68 in the center of the battery door 14 between the first and second end portions 62 and 64, and a contact tab 70 on the second end portion 64. By molding the contacts 48 and 50 directly into the battery door 14, the contacts 48 and 50 and battery 12 rotate together with the battery door 14 to eliminate any noise which might be created if the contacts were fixed in the battery door boot 16.

The flex pivot area 68 includes a semicircular recess 72, which is adapted to receive the pivot pin 30. The interaction between the semicircular recess 72 and the pivot pin 30 allows the battery door 14 to pivot within the battery door boot 16. In addition to allowing the battery door 14 to pivot in the battery door boot 16, the semicircular recess 72 also allows the battery door 14 to be removed from the battery door boot 16 for replacement of the battery 12 or maintenance of the switches 22 and 24.

The contact tab 70 allows a flex connector 74 or solenoid lead to be connected with the battery 12 and the hearing aid circuitry (not shown). The battery door boot 16 also preferably includes an aperture 76, which is adapted to receive the flex connector 74. The aperture 76 allows a length of the flex connector 74 that is in the battery door boot 16 to be adjusted so that the flex connector 74 does not interfere with the pivoting of the battery door 14 in the battery door boot 16.

The first switch activation area 52 is located proximate to an end of the base portion 42 adjacent to the first leg portion 44, and the second switch activation area 54 is located proximate to an end of the base portion 42 adjacent to the second leg portion 46. The first and second switch activation areas 52 and 54 are shown as outward lateral extensions 78 and 80, respectively, from the base 42. Each lateral extension 78 and 80 overlays one of the switches 22 and 24, respectively.

The battery door 14 also preferably includes a handle 58 that is mounted on the base portion 42. The handle 58 provides a grip to assist in pivoting of the battery door 14 in the battery door boot 16 or removing the battery door 14 from the battery door boot 16.

An external force applied to the first switch activation area 52 causes the battery door 14 to pivot about pivot pins 30 as indicated by arrow 84. Pivoting causes the first lateral extension 78 to contact the rubber shell 40 and close the first conductive switch 22 for hearing aid control. Upon removal of the external force, the rubber shell 40 springs back to its original position to open the first conductive switch 22 and thereby return the first lateral extension 78 to its original position.

An external force applied to the second switch activation area 54 causes the battery door 14 to pivot in an opposite direction about pivot pins 30 as indicated by arrow 86. Pivoting causes the second lateral extension 80 to contact the rubber shell 40 and dose the second conductive switch 24 for hearing aid control. Upon removal of the external force, the rubber shell 40 springs back to its original position to open the second conductive switch 24 and thereby return the second lateral extension 80 to its original position.

For example, if the conductive switches 22 and 24 control amplification volume, activation of the first control switch 22 increases the volume while activation of the second control switch 24 deceases the volume. The conductive switches 22 and 24 and circuitry may be programmed to be incremental switches such that the volume is increased or decreased at discrete incremental levels upon each activation of the switch. Alternatively, the conductive switches 22 and 24 and circuitry may be programmed to be analog switches such that the volume is increased or decreased depending on the amount of time the switch is closed.

If the switch control circuitry is further programmed, then one conductive switch 22 may control one hearing aid function while the other conductive switch 24 may control another hearing aid function. In this arrangement, a conductive switch 22 or 24 is activated and held closed to increase volume, for example. After the same switch is released, its next activation decreases the volume, and so on. It is to be noted that the placement of the switches 22 and 24 may be varied along the entire battery door boot 16 so long as the conductive switch 22 and 24 are activated by motion of the battery door 14.

Figure 3:
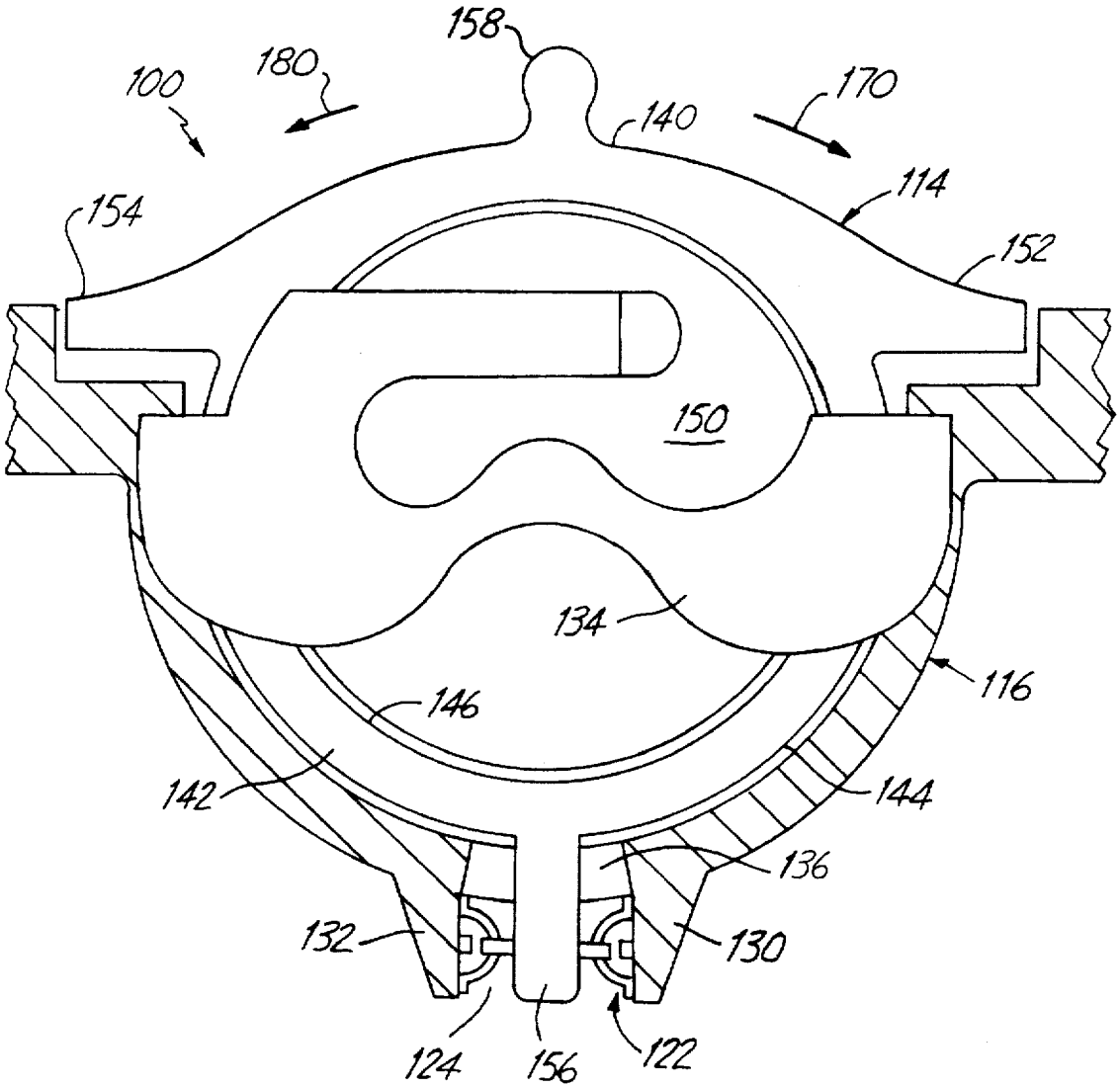
FIG. 3 is a sectional view of an alternative embodiment of the hearing aid switch apparatus.

The location of control switches 122 and 124 in the hearing aid 100 has been varied in accordance with the teachings of the present invention as illustrated in FIG. 3. More particularly, the battery door 114 and battery door boot 116 have been modified so that the control switches 122 and 124 are formed on an underside of the battery door boot 116.

The battery door boot 116 includes first and second flanges 130 and 132, and a channel 136 therebetween. The control switches 122 and 124 are located on the first and second flanges 130 and 132, respectively, and oriented so as to face each other.

With this embodiment, the battery contacts 134 are preferably molded into the battery door boot 116 along opposite sides of the battery door 114. Other than this difference, the battery contacts 134 are similar to the battery contacts described with reference to the embodiment illustrated in FIGS. 1 and 2.

The battery door 114 includes a base portion 140, a semicircular portion 142, a first switch activation area 152, a second switch activation area 154, and a switch activator lever 156. The semicircular portion 142 extends from the base portion 140 to form a receptacle that is adapted to receive a battery 150.

An exterior edge 144 of the semicircular portion 142 substantially conforms with the surface of the battery door boot 116. An interior edge 146 of the semicircular portion 142 substantially conforms with a profile of the battery 150. The battery door 114 thereby retains the battery 150 in the battery door boot 116 so that the battery 150 is adjacent to and in contact with the battery contacts 134.

The first and second switch activation areas 152 and 154 have characteristics similar to the switch activation areas described with reference to the embodiment illustrated in FIGS. 1 and 2. The switch activator lever 156 is an extension on an underside of the battery door 114 and extends through the channel 136 in between the first and second conductive switches 122 and 124. The first and second conductive switches 122 and 124 operate in the same manner as the switches shown and described with respect to the embodiment illustrated in FIGS. 1 and 2.

The battery door 114 also preferably includes a handle 158 that extends from the base portion 140. Similar to the handle shown and described with respect to the embodiment illustrated in FIGS. 1 and 2, the handle 158 provides a grip for pivoting of the battery door 114 in the battery door boot 116 and removing the battery door 114 from the battery door boot 116.

Upon applying external pressure to the first switch activation area 152, the battery door 114 pivots in the battery door boot 116 as indicated by arrow 170. Pivoting of the battery door 114 causes the switch activator lever 156 to contact and close the first conductive switch 122 for performing a hearing aid control function. When the external pressure is removed, the resilient nature of the conductive switch 122 returns the battery door 114 to its original position.

Upon applying external pressure to the second switch activation area 154, the battery door 114 pivots in the battery door boot 116 as indicated by arrow 180. Pivoting of the battery door 114 causes the switch activator lever 156 to contact and close the second conductive switch 124 for performing a hearing aid control function.

Figure 4:
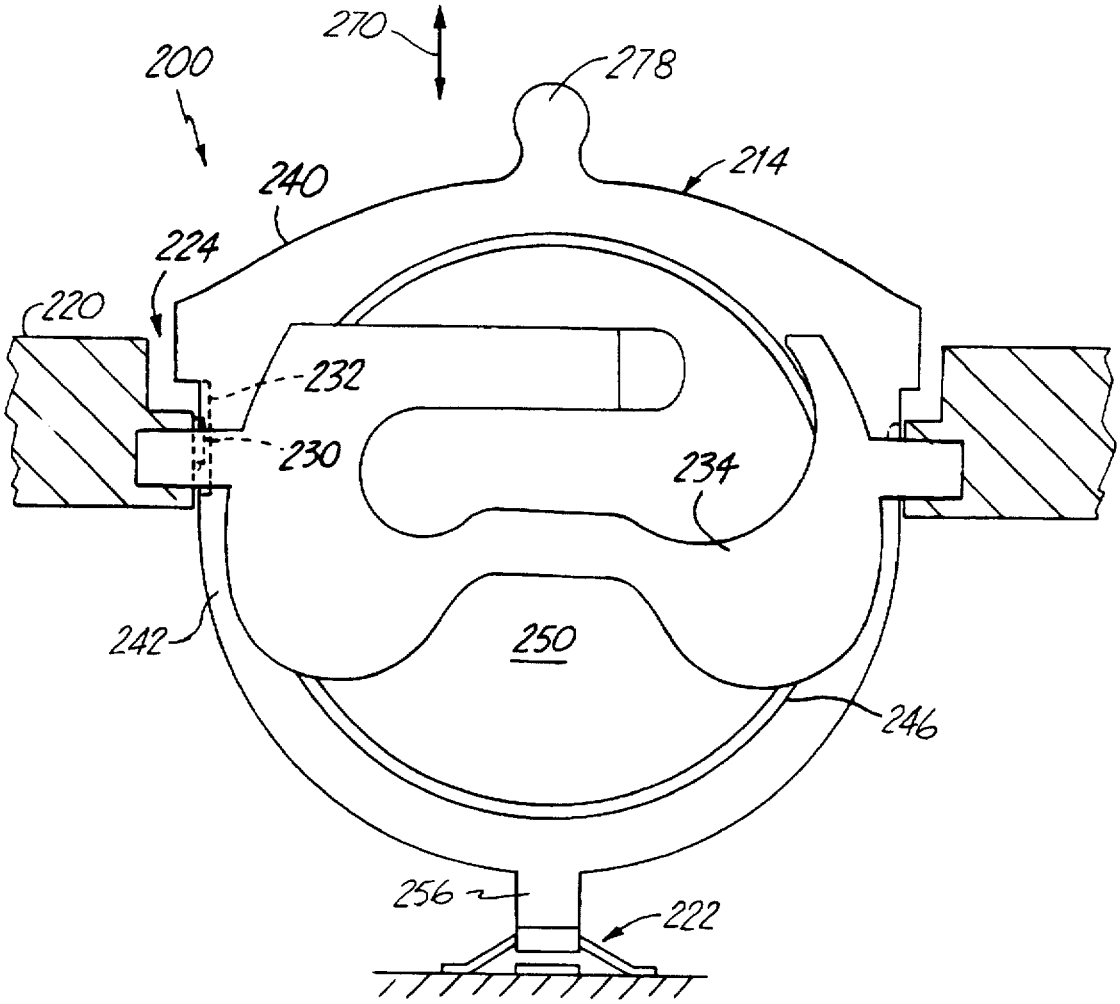
FIG. 4 is a sectional view of another alternative embodiment of the hearing aid switch apparatus.

In yet another embodiment of the present invention, the location and operation of control switch 222 in the hearing aid 200 has been varied in accordance with the teachings of the present invention as illustrated in FIG. 4. In this embodiment, a faceplate 220 has an opening 224 that is adapted to receive a battery door 214. The faceplate 220 includes battery contacts 234 that are molded into the faceplate 220 so as to extend across the opening 224. The faceplate 220 also includes pivot pins 230 that are mounted into edges of the faceplate 220 between the battery contacts 234.

Similar to the embodiment described with reference to FIG. 3, the battery door 214 has a base portion 240 and a semicircular portion 242. The semicircular portion 242 extends from the base portion 240 to form a circular receptacle that is adapted to receive a battery 250.

An interior edge 246 of the semicircular portion 242 substantially conforms with the profile of the battery 250. Proximate to the base portion 240, the semicircular portion 242 includes channels 232 that are adapted to receive the pivot pins 230. The battery door channels 232 retain the battery door 214 in a desired orientation with respect to the faceplate 220 and allow the battery door 214 to slide in a reciprocating motion with respect to the faceplate 220 as indicated by arrow 270. In this arrangement, a battery door boot, such as was described with reference to FIGS. 1 and 2, is not needed as the battery door 214 is held in position at the pivot pins 230.

The battery door 214 includes a switch activation area in the form of a handle 278 protruding from a top surface of the battery door 214, and a switch actuator lever 256 that extends from an underside of the battery door 214. The handle 278 also provides a grip to remove the battery door 214 from the faceplate 220.

In this arrangement, a single control switch 222 is positioned below the switch actuator lever 256. Upon applying external pressure to the switch activation area 250, the battery door 214 is reciprocated downward in the direction of arrow 270 as the housing pins 230 move in battery door channels 232. The movement of the battery door 214 causes the switch activator lever 256 to contact and close the control switch 222 for performing a hearing aid control function. When the external pressure is removed, the resilient nature of the control switch 222 returns the battery door 214 to its original position. The switch and switch circuitry operate in a similar manner to the switches shown and described with respect to the embodiment illustrated in FIGS. 1 and 2. In this arrangement, the switch 222 is activated by depression of the battery door handle 278 and held closed to incrementally increase the volume, for example. After the switch 222 is released, the next switch activation incrementally decreases the volume, and so on.

Although the present invention has been described with reference to preferred embodiments, workers skilled in the art will recognize that changes may be made in form and detail without departing from the spirit and scope of the invention.

What is claimed is:

1. A hearing aid comprising:

a faceplate having an opening formed therein;

a switch operably disposed in the hearing aid for control of the hearing aid, wherein the switch is movable between an activated position and an inactivated position, and wherein the switch is biased to the inactivated position; and a battery door mounted within the opening, wherein the battery door has a switch activation area, wherein applying an external force to the switch activation area pivots the battery door from an initial position and moves the switch to the activated position, and wherein the switch causes the battery door to pivot back to the initial position upon removal of the external force.

2. The hearing aid of claim 1 wherein a battery door boot is in communication with the opening.

3. The hearing aid of claim 2 wherein the battery door comprises:

a base;

a plurality of legs extending from the base; and a plurality of battery contacts mounted to the legs and extending between the legs, wherein the legs and the battery contacts form a receptacle that receives a battery and thereby retains the battery in the battery door.

4. The hearing aid of claim 3 wherein the battery door boot has a plurality of opposed side walls and a base wall extending between the side walls, wherein the battery door boot further includes a plurality of pivot pins mounted to the side walls, wherein each of the battery contacts includes a recess that receives one of the pivot pins when a portion of the battery door is inserted into the battery door boot, and wherein the interaction between the recesses and the pivot pins allows the battery door to pivot in the battery door boot.

5. The hearing aid of claim 2 wherein the battery door has a base portion and a semicircular portion that form a receptacle that receives a battery, wherein the battery door has a switch activator lever extending therefrom, and wherein the switch activator lever includes the switch activation area.

6. The hearing aid of claim 5 wherein the battery door boot comprises:

a plurality of opposed side walls and a base wall extending between the side walls;

a plurality of battery contacts formed into the battery door boot;

a channel formed into the base wall and adapted to receive switch activator lever, wherein the switches are retained adjacent to the switch activator lever and the channel; and wherein the battery door is pivotable in the battery door boot resulting in the switch activator lever activating the switch.

7. The hearing aid of claim 5 wherein the faceplate further comprises a plurality of pivot pins mounted adjacent to the opening, wherein the battery door further comprises a plurality of channels formed therein, and wherein the pivot pins engage the channels while allowing the battery door to reciprocally pivot with respect to the faceplate.

8. The hearing aid of claim 7 wherein the switch is mounted proximate to the switch activator lever, wherein the switch is activated when battery door pivots with respect to the faceplate.

9. A hearing aid switch arrangement for use in a hearing aid having a hearing aid audio component, the hearing aid switch arrangement comprising:

a hearing aid housing having a battery door boot formed therein;

a battery door capable of receiving a battery therein, wherein the battery door is movable within the battery door boot;

a first switch operably connected to the hearing aid audio component and operably disposed in the hearing aid housing; and a second switch operably connected to the hearing aid audio component and operably disposed in the hearing aid housing, wherein movement of the battery door with respect to the hearing aid housing alternatively activates the first switch and the second switch for control of the hearing aid.

10. The hearing aid switch arrangement of claim 9 wherein the battery door comprises:

a base;

a plurality of legs extending from the base; and a plurality of battery contacts mounted to the legs and extending between the legs, wherein the legs and the battery contacts form a receptacle that receives the battery and thereby retains the battery in the battery door.

11. The hearing aid switch arrangement of claim 10 wherein the battery door boot has a plurality of opposed side walls and a base wall extending between the side walls, wherein the battery door boot further comprises a plurality of pivot pins mounted to the side walls, wherein each of the battery contacts includes a recess that receives one of the pivot pins when a portion of the battery door is inserted into the battery door boot, and wherein the interaction between the recesses and the pivot pins allows the battery door to pivot in the battery door boot.

12. The hearing aid switch arrangement of claim 11 wherein the battery door has a base portion and a semicircular portion that form a receptacle that receives the battery and wherein the battery door has a switch activator lever extending therefrom.

13. The hearing aid switch arrangement of claim 12 wherein the battery door boot comprises:

a plurality of opposed side walls and a base wall extending between the side walls;

a plurality of battery contacts formed into the battery door boot;

a channel formed into the base wall and adapted to receive the switch activator lever, the switches being retained adjacent to the switch activator lever and the channel; and wherein the battery door is pivotable in the battery door boot resulting in the switch activator lever activating the switch.

14. The hearing aid switch arrangement of claim 12 wherein the faceplate further comprises a plurality of pivot pins mounted in the hearing aid housing, wherein the battery door further comprises a plurality of channels formed therein, and wherein the pivot pins engage the channels while allowing the battery door to reciprocally pivot with respect to the faceplate.

15. The hearing aid switch arrangement of claim 14 wherein the first switch is mounted proximate the switch activator lever, wherein the first switch is activated when the battery door pivots with respect to the faceplate.

16. A hearing aid battery door for use in a hearing aid having a hearing aid audio component, the hearing aid battery door comprising:

a battery housing for holding a battery, the battery housing being movable within a hearing aid housing;

a first switch activation area operable with the battery housing for contacting a first conductive switch for control of the hearing aid audio component; and a second switch activation area operable with the battery housing for contacting a second conductive switch for control of the hearing aid audio component, wherein the first switch activation area is opposite the second switch activation area.

17. The hearing aid battery door of claim 16 wherein the battery door comprises:

a base;

a plurality of legs extending from the base; and a plurality of battery contacts mounted to the legs and extending between the legs, the legs and the battery contacts forming the battery housing.

18. The hearing aid battery door of claim 16 wherein the battery door has a base portion and a semicircular portion that form the battery housing, wherein the battery door has a switch activator lever extending therefrom, and wherein the switch activator lever includes the first and second switch activation areas.

19. A method for controlling a hearing aid audio component by activating a first switch, wherein the hearing aid audio component and the first switch are mounted to a hearing aid, wherein the first switch is movable between an activated position and an inactivated position, the method comprising:

providing a battery door on the hearing aid, wherein the battery door has a first switch activation area for activating the first switch;

biasing the first switch to the inactivated position;

applying a first external force to the first switch activation area to pivot the battery door from an initial position and move the first switch to the activated position; and pivoting the battery door back to the initial position upon removal of the first external force.

20. The method of claim 19, wherein the hearing aid further comprises a second switch for controlling the hearing aid audio component, wherein second switch is movable between an activated position and an inactivated position, and wherein the battery door further comprises a second switch activation area for activating the second switch, wherein the method further comprises:

biasing the second switch to the inactivated position;

applying a first external force to the second switch activation area to pivot the battery door from the initial position and move the second switch to the activated position; and pivoting the battery door back to the initial position upon removal of the second external force.

21. The method of claim 20, wherein the battery door is alternatively movable in response to the first and second external forces to activate the first and second switches, respectively.

* * * * *